US006647906B2

(12) United States Patent
Sadasue

(10) Patent No.: US 6,647,906 B2
(45) Date of Patent: Nov. 18, 2003

(54) LOOP FORMING DEVICE USED FOR A CHAINSTITCH SEWING MACHINE

(75) Inventor: Kazuya Sadasue, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/152,693

(22) Filed: May 22, 2002

(65) Prior Publication Data

US 2002/0195036 A1 Dec. 26, 2002

(30) Foreign Application Priority Data

May 23, 2001 (JP) ..... P. 2001-153597

(51) Int. Cl.[7] ..... D05B 1/10; D05B 61/00
(52) U.S. Cl. ..... 112/165; 112/260
(58) Field of Search ..... 112/165, 260, 112/235, 288, 176, 197, 199, 200

(56) References Cited

U.S. PATENT DOCUMENTS 4,430,878 A * 2/1984 Dispennett et al. ..... 72/340
4,984,526 A * 1/1991 Ide et al. ..... 112/162
5,503,094 A * 4/1996 Tseng ..... 112/260
6,098,555 A * 8/2000 Sakuma ..... 112/165

FOREIGN PATENT DOCUMENTS

JP 2000-93671 8/2000

* cited by examiner

*Primary Examiner*—Ismael Izaguirre
(74) *Attorney, Agent, or Firm*—Merchant & Gould P.C.

(57) ABSTRACT

Disclosed is a chainstitch sewing machine having a plurality of needles having needle threads which are moved up and down through needle holes of a throat plate, a looper having a looper thread, which is reciprocatively moved in a direction orthogonal to a cloth feeding direction under the throat plate, guide holes provided in the throat plate for guiding loops formed by the needle threads and a looper thread by the cooperation of the needles and the looper, to a rear part in a cloth feeding direction, and a main feed dog, disposed at a part closer to a rear than the guide hole, for feeding the loops in the cloth feeding direction. Improvement is made such that the upper end edge of the needle hole located at a rear part as viewed in the cloth feeding direction, takes a planar shape configured such that a part thereof located closer to the forward movement end of the looper is gradually varied toward the needles with respect to a straight line orthogonal to a cloth feed direction, and a thread guide surface, which is chamfered off to become thin in the forward direction of the looper and toward the lower surface of the throat plate, is provided on the upper edge of the guide hole.

7 Claims, 7 Drawing Sheets

LOOP FORMING DEVICE USED FOR A CHAINSTITCH SEWING MACHINE

BACKGROUND OF THE INVENTION

1. Field of the Invention

The present invention relates to a loop forming device for a chainstitch sewing, and more particularly to a loop forming device for successively forming the empty rings of yarn by a plurality of needle threads and a looper thread.

2. Description of the Related Art

A well known technique is disclosed in Japanese patent laid-open No. 2000-93671. This technique will be described with reference to FIGS. 8 and 9.

FIG. 8 is a perspective view showing a cloth holding device and a throat plate, and reference numeral 20 designates a support member detachably mounted on the lower end of the presser bar (not shown). Reference numeral 21 designates a cloth holder part, which is rotatably supported at the lower end of the support member 20 by its horizontal shaft 22. Reference numeral 23 indicates a loop holder, which is rotatably supported by a shaft 23A oriented horizontal to the cloth holder part 21.

Reference numeral 24 indicates a throat plate claw plate. Needle location holes 24A, as needle location parts, for three needles N, a gate-shaped slit 24B formed in front of the needle location holes 24A as viewed in the cloth feeding direction, and an edge sewing-up pawl 24C are provided on the throat plate claw plate 24, and its base end is fastened to a throat plate 25.

Three arcuate hollow parts 25A to 25C shown in FIG. 9 are provided at a location under the needle location holes 24A of the throat plate claw plate 24 of the throat plate 25. A thread setter 25F having two engaging claws 25D and 25E which are slanted upward in the cloth feeding direction and provided among the arcuate hollow parts 25A to 25C, is further provided on the throat plate 25. A cloth feed dog 27 through which an auxiliary feed dog 26 appears and disappears and a main feed gear hole 30 through which a main feed dog 29 including a center loop feed dog 28 appears and disappears, are formed in the throat plate 25. Reference numeral 31 is a looper. The width of the loop feed dog 28 in a direction perpendicular to the cloth feeding direction is narrower than the width of an array of the three needles N. Operation of the conventional technique described above will briefly be described.

When the sewing machine is driven, the three needles N vertically moves interlocking with the main shaft (not shown). A looper 31 swings around the needles on a planar shape, while drawing an elliptical locus, and the main feed dog 29 and the auxiliary feed dog 26 perform four movements of cloth feeding.

Motion relationship of those needles N, the looper 31 and the feed dog will be described. The description will start from a state that the needles N are at the bottom dead point, the looper 31 is at the most retracted position, and the feed dog is under the throat plate.

The needles N starts to slightly lift from the bottom dead point. Then the looper 31 starts to advance, the needle threads NT of the three needles N are looped, and those needle threads looped are successively caught by the point of a sword of the looper 31.

The needle thread loop caught by the looper 31 is pulled in the advancing direction of the looper 31. The needle thread loop is retained at the retaining claws 25D and 25E provided among the arcuate hollow parts 25A to 25C as shown in FIG. 9, are set at the arcuate hollow parts 25A to 25C.

The needles N further lift and the looper 31 also proceeds, and the needle threads NT are taken up by a thread take-up lever (not shown).

The needles N further lift and reach the top dead point, and then starts to descend. The looper 31 advances while moving in the direction opposite to the cloth feeding direction, and after it reaches the most advanced position, and then start to retract.

The three needles N having descended, as shown in FIG. 10, are caught by the looper 31, and reaches the lower most point in a state that it is placed in a called triangle of the needle threads NT extending in the cloth feeding direction.

The up and down movement of the needles N and the reciprocal motion of the looper 31 are repeated, and loops 32 as a chain-off thread are formed, as shown in FIG. 9, in the cloth feeding direction by the three needles N and a single looper thread LT. The loops 32 are fed in the cloth feeding direction by a loop feed dog 28 of the main feed dog 29 and the loop holder 23.

The conventional technique, however, involves the following problems.

The loops 32, which is formed in the cloth feeding direction by the three needles N and the single looper thread LT, is swung to the front and rear, and to the right and left by the up/down motion of the needles N and the reciprocating motion of the looper thread L. The needle threads NT that are retained at the retaining claws 25D and 25E as indicated by solid lines in FIG. 9 climb over the retaining claw 25E as indicated by a two-dot chain line, and are retained at the retaining claw 25D. And those threads are unable to return to their original positions, and the subsequent formation of loops is impossible.

The loops 32 fed in the cloth feeding direction are pulled out in the cloth feeding direction by the loop feed dog 28 of the main feed dog 29 and the loop holder 23, and the fore ends of the loops 32 are pulled to the center to be narrow as shown in FIG. 9. A called triangle of the needle threads NT, which are caught by the looper 31 and extend in the cloth feeding direction, becomes small as indicated by a two-dot chain line FIG. 10. The needle does not fall to within the triangle and the stitch skipping occurs, and the loop cannot be formed.

The width of the loop feed dog 28 in a direction orthogonal to the cloth feeding direction is narrow than the width of the needle location part of the three needles N. The fore ends of the loops 32, which are pulled out in the cloth feeding direction to be narrow, are deviated sideways from the loop feed dog 28 as shown in FIG. 11, and loops cannot be fed in the cloth direction, and it is impossible to form the loops.

SUMMARY OF THE INVENTION

To achieve the above object, there is provided a chainstitch sewing machine having a plurality of needles having needle threads which are moved up and down through needle holes of a throat plate, a looper having a looper thread, which is reciprocatively moved in a direction orthogonal to a cloth feeding direction under the throat plate, guide holes provided in the throat plate for guiding loops formed by the needle threads and a looper thread by the cooperation of the needles and the looper, to a rear part in a cloth feeding direction, and a main feed dog, disposed at a part closer to a rear than the guide hole, for feeding the loops in the cloth feeding direction, the improvement being characterized in that the upper end edge of the needle hole located at a rear part as viewed in the cloth feeding direction, takes a planar shape configured such that a part thereof located closer to the forward movement end of the looper is gradually varied toward the needles with respect to a straight line orthogonal to a cloth feed direction, and a thread guide surface, which is chamfered off to become thin in the forward direction of the looper and toward the lower surface of the throat plate, is provided on the upper edge of the guide hole.

In the chainstitch sewing machine mentioned above, the loops are fed out by a loop holder and a loop feed dog, the loops are expanded, so that the needle threads being in contact with the thread guide surface move along the guide surface and in a direction that the needle threads separate from each other. As a result, the needle threads are caught by the looper, a called triangle of a needle thread NT extending in the cloth feeding direction becomes large. The needle reliably drops into the triangle, and no stitch skipping occurs. Accordingly, the loops are formed reliably.

In the chainstitch sewing machine, the planar shape is arcuate.

With this feature, the effects referred to above is enhanced.

In the chainstitch sewing machine characteristically featured, the thread guide surface may be chamfered to be arcuate.

In the chainstitch sewing machine having the last mentioned feature, a plurality of needle thread loops ranging from the under surface of the looper to the thread guide surface are moved in the cloth feeding direction while contacting with the arcuate chamfered part of the thread guide surface. Therefore, no thread breakage occurs and the loops can reliably be formed.

In the chainstitch sewing machine having any of the features mentioned above, a plurality of thread guide grooves for guiding a plurality of needle thread loops ranging from the under surface of the looper to the thread guide surface are provided in the lower surface of the throat plate located between a needle location part of the throat plate and the thread guide surface of the guide hole.

In the chainstitch sewing machine having the just-mentioned feature, a plurality of needle thread loops ranging from the under surface of the looper to the thread guide surface are reliably guided by the thread guide grooves. This feature ensures reliable formation of the loops.

In the chainstitch sewing machine having the just-mentioned feature, a rear pat of each thread guide groove is arcuate directed downward in the cloth feeding direction.

In the chainstitch sewing machine having this feature, the loops are smoothly retracted, whereby beautiful stitches are formed.

In the chainstitch sewing machine having any of the technical features stated above, the thread guide surface the thread guide grooves closer to on the backward movement end of the looper are located at positions closer to outside than a needle location located closer to the backward movement end of the looper.

In the chainstitch sewing machine having this feature, the needle threads are caught by the looper, a called triangle of a needle thread NT extending in the cloth feeding direction becomes large. The needle reliably drops into the triangle, and no stitch skipping occurs. Accordingly, the loops are formed reliably.

In the chainstitch sewing machine having any of the features stated above, the width of the main feed dog is broader than the width of a plurality of needle location parts of the throat plate.

The chainstitch sewing machine thus constructed is capable of reliably feeding the loops by the main feed dog.

DESCRIPTION OF THE PREFERRED EMBODIMENTS

The preferred embodiments of the present invention will be described with reference to FIGS. 1 through 6.

A chainstitch sewing machine of the embodiment is a chainstitch sewing machine capable of forming both the edge sewing-up sewing and the flat sewing.

Figure 1:
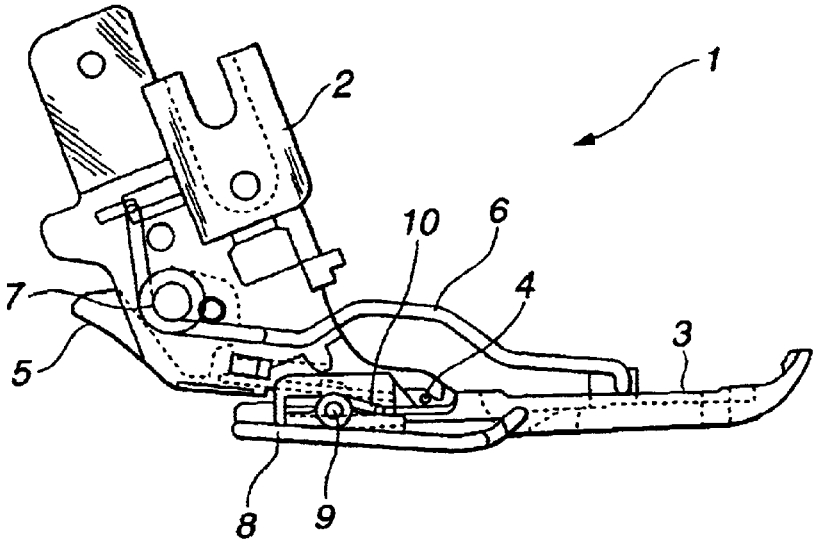
FIG. 1 is a side view showing a cloth holding device constructed according to the present invention.

FIG. 1 is a side view of a cloth holding device 1, and reference numeral 2 designates a support member detachably mounted on the lower end of the presser bar (not shown). Reference numeral 3 designates a cloth holder, and its horizontal shaft 4 is detachable from the lever 5 with respect to the lower end of the support member 2 by means of a lever 5. Reference numeral 6 is a spring, and its base end is supported on a shaft 7 of the support member 2. The tip of the spring is brought into pressing contact with the upper and of the fore part of the cloth holder 3, and gives the cloth holder 3 a rotational force causing it to rotate clockwise about the horizontal shaft 4. Reference numeral 8 designates a loop holder which is rotatably supported on a shaft 9 oriented horizontal to the cloth holder 3. It receives a rotational force to rotate clockwise about the shaft 9, from a spring 10.

Figure 2:
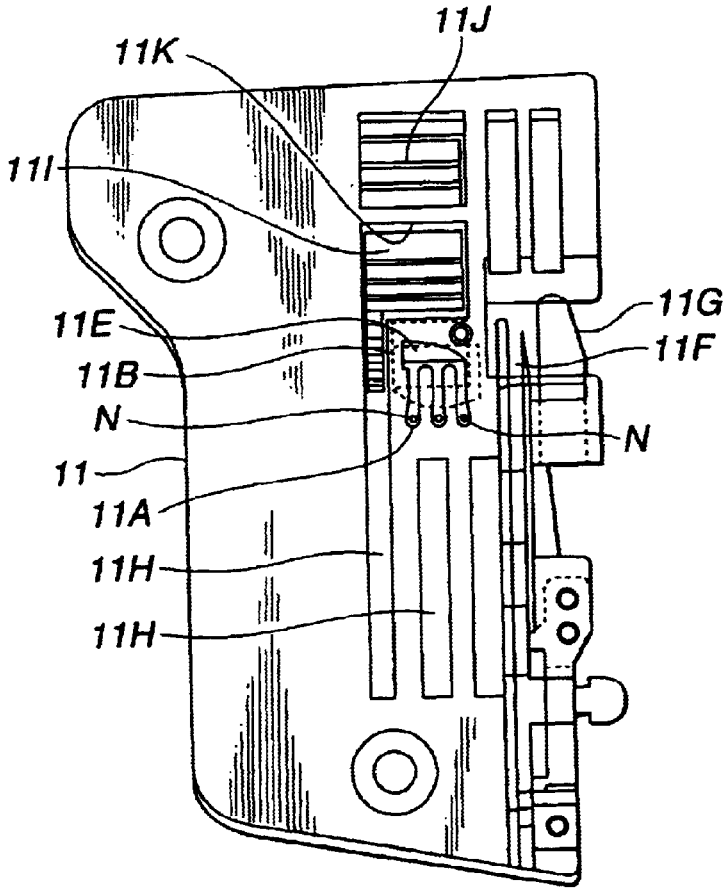
FIG. 2 is a plan view showing a throat plate constructed according to the invention.
Figure 3:
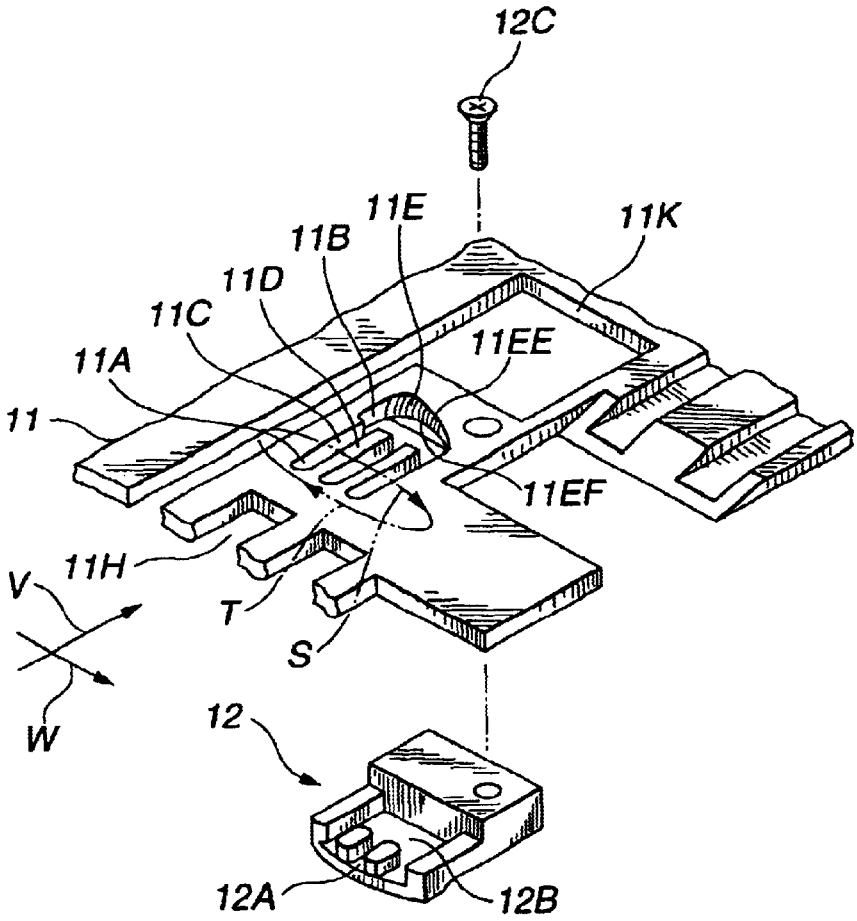
FIG. 3 is a parial, exploded view showing a perspective view showing a throat plate.

FIGS. 2 and 3 are a plan view and a partial perspective view showing a throat plate 11 of the invention. Three needle holes 11A for flat sewing as a needle location through which three needles N pass, and a loop needle hole 11B in front of the needle holes 11A as viewed in the cloth feeding direction, are formed at the central part of the throat plate 11. The needle holes 11A communicate with the needle hole 11B by way of three slits 11C which are parallel and extended in the cloth feeding direction. Those slits 11C form two slide pieces 11D.

Figure 4:
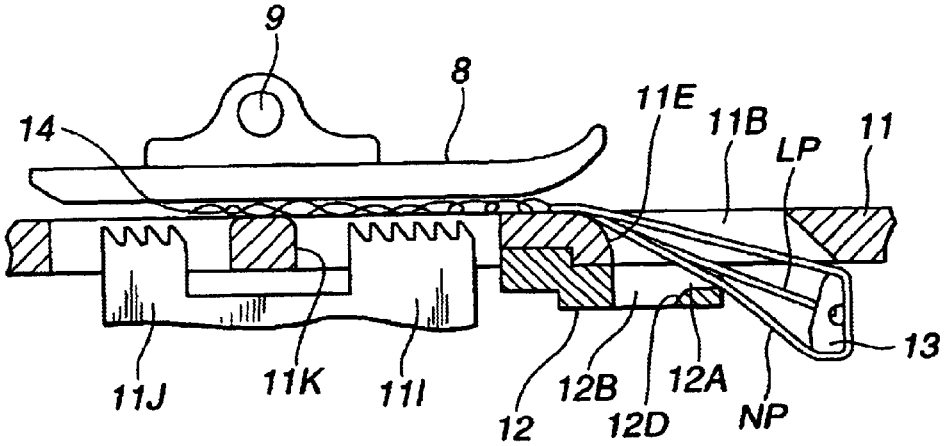
FIG. 4 is a cross sectional view showing a central portion of the throat plate of the present invention.

The upper end edge 11EE of the needle hole 11B as viewed in the cloth feeding direction, with which the loop as fed engages, takes an arcuate planar shape which is configured to gradually vary toward the forward movement end S of a looper (double ring) 13 and in a direction in which it approaches to the needle, with respect to a straight line W orthogonal to a cloth feed direction U. A thread guide surface 11E, which is chamfered off to become thin to the forward direction S of the looper and toward the lower surface of the throat plate, is provided on the upper edge 11EE of the guide hole. As shown in FIG. 4, the thread guide surface 11E is chamfered off to be arcuate.

As shown in FIG. 2, an edge sewing-up needle hole 11F for edge sewing-up and a slide piece 11G are formed on the right part of the portion where the needle holes 11A are formed.

A cloth feed dog 11H through which the auxiliary feed dog appears and disappears is formed in a region on the near side and the left side of the needle holes 11A as viewed in the cloth feeding direction. A cloth feed dog 11K through which the loop feed dog 11I and the main feed dog 11J appear and disappear is formed in the rear part of the needle holes 11A in the cloth feeding direction. The width of the loop feed dog 11I is wider than the width of the plurality of the needle location parts.

In FIG. 3, reference numeral 12 is a thread guide member. The thread guide member 12 includes three thread guide grooves 12A arrayed in parallel in the cloth feeding direction, and a through hole 12B in front of the thread guide grooves 12A as viewed in the cloth feeding direction. The base end of the thread guide member 12 is fastened to the lower surface of the throat plate 11 by means of a screw 12*c*. The bottom surface of the rear part of the thread guide groove 12A as viewed in the cloth feed direction, as shown in FIG. 4, is formed to have an arc 12D directed downwards in the cloth feeding direction.

In FIG. 4, reference numeral 4 designates a looper. The thread guide surface 11E and the thread guide grooves 12A, located closer to the backward movement T end of the looper, are located at positions closer to the outside than the needle location on the backward movement T end of the looper 13. Accordingly, a called triangle of each needle thread NT, which is caught by the looper 13 and extends in the cloth feeding direction, becomes large. Hence, the needles reliably fall to within the triangle, and the stitch skipping does not occur, whereby loops are reliably formed.

Operation of the loop forming device of the invention will be described.

When the sewing machine is driven, the three needles N vertically moves interlocking with the main shaft (not shown). The looper 13 swings around the needles in a planar shape, while drawing an elliptical locus, and the main feed dog 11J and the auxiliary feed dog perform four movements of cloth feeding. The forward direction of the reciprocative movement of the looper 13 will be referred to as S, and the backward direction will be referred to as T.

Motion relationship of those needles N, the looper 13 and the feed dog will be described. The description will start from a state that the needles N are at the bottom dead point, the looper 13 is at the most retracted position, and the feed dog is under the upper surface of the throat plate.

The needles N starts to slightly lift from the bottom dead point. Then the looper 13 starts to advance, the needle threads NT of the three needles N are looped, and those needle threads looped are successively caught by the point of a sword of the looper 31.

Figure 5:
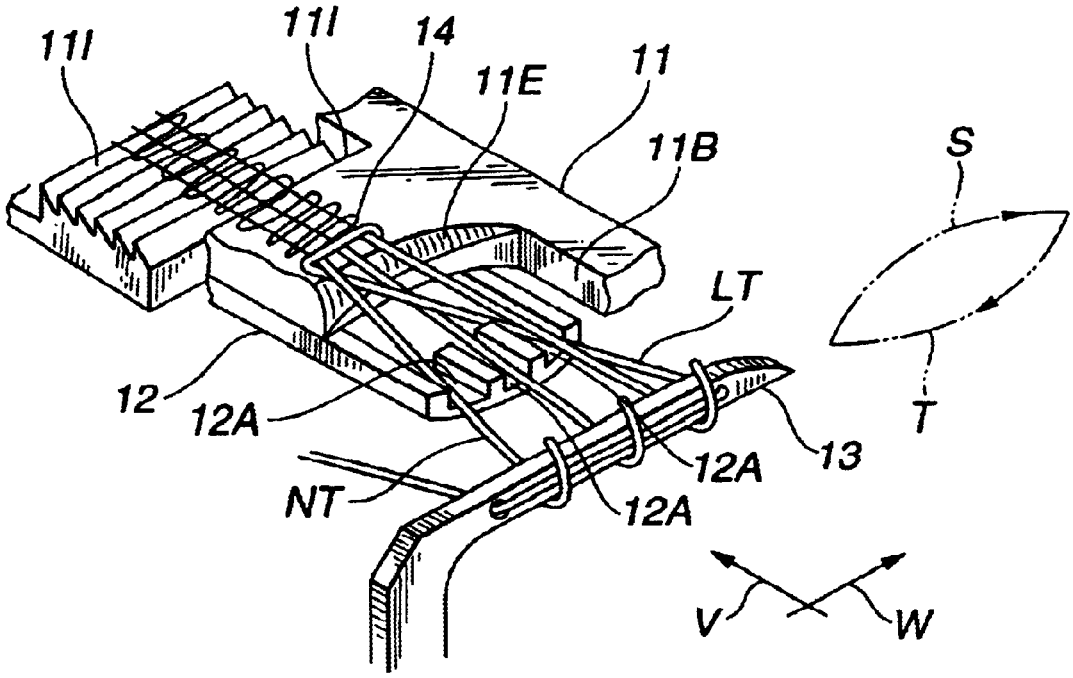
FIG. 5 is a perspective view showing needle threads caught by the looper of the invention and a state of a looper thread.

The needle thread loop caught by the looper 13 is pulled in the advancing direction of the looper 31, and a looper threads LT is taken up by a looper take-up lever (not shown) and is stretched. Each of the needle threads N, as shown in FIGS. 4 and 5, is guided into and set at the thread guide grooves 12A formed in the thread guide member 12.

The needles N further lift and the looper 30 also proceeds, and the needle threads NT are taken up by a thread take-up lever (not shown).

The needles N further lift and reach the top dead point, and then starts to descend. The looper 13 also advances while moving in the direction opposite to the cloth feeding direction, and after it reaches the most advanced position, and then starts to retract.

As described above, when the needles starts to lift and the tip ends thereof get out of the cloth (not shown) in the upward direction, the upper surface of the main feed dog 11J having a loop feed dog 11I and the auxiliary feed dog lift upward from the upper surface of the throat plate 11. The cloth holder 3 and the loop holder 8 cooperate with each other to feed cloth (not shown) and the loops 14 in the cloth feeding direction, and then the main feed dog 11J and the auxiliary feed dog go downward from the upper surface of the throat plate 11.

Figure 6:
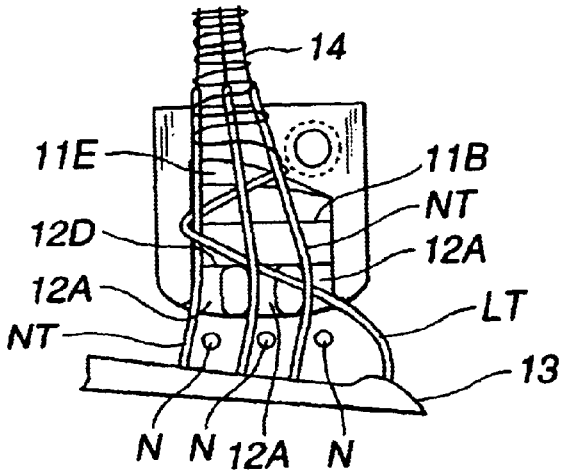
FIG. 6 is a plan view showing needle threads caught by the looper of the invention and a state of a looper thread.

As described above, the three needles N start to descend, as shown in FIG. 6, and the three needle threads NT that are fed by the loop feed dog 11I in a state that those are caught by the looper 13, are reliably guided by the thread guide grooves 12A, respectively. At this time, the needle threads NT being in contact with the thread guide surface 11E, move apart from with each other along the thread guide surface 11E. With this feature, a called triangle of each needle thread NT, which is caught by the looper 13 and extends in the cloth feeding direction, becomes large. Hence, the needles N reliably fall within the triangle, and the stitch skipping does not occur, whereby loops are reliably formed.

The needles N reach the lower most point in a state that it is in a called triangle of each needle thread NT, and the looper 13 is placed at the most retracted position.

The up and down movements of the needles N and the reciprocal motion of the looper 13 are repeated, and the loops 14 are formed in the cloth feeding direction by the three needles N and the single looper thread LT.

It should be understood that the invention is not limited to the above-mentioned embodiments, and may variously be modified, altered and changed within the scope of the invention.

For example, as shown in FIG. 5, the looper 13 is reciprocatively moved from the left side to the right side in the figure. When the invention is applied to the sewing machine of which the looper is reciprocatively moved from the right side to the left side, the thread guide surfaces may be formed reversed in the horizontal direction.

Figure 7A:
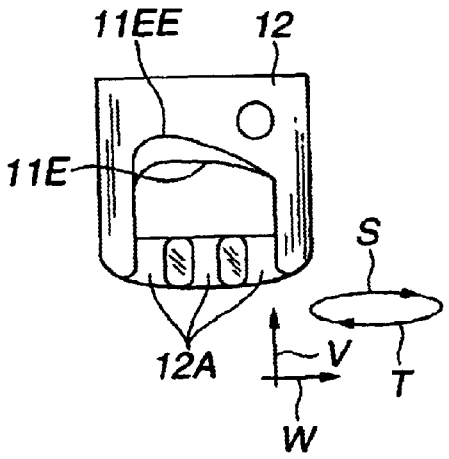
FIG. 7 is a plan view showing another embodiment of a thread guide member of the invention.
Figure 7B:
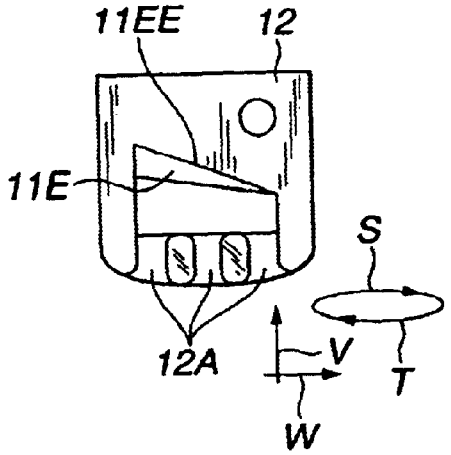
Figure 8:
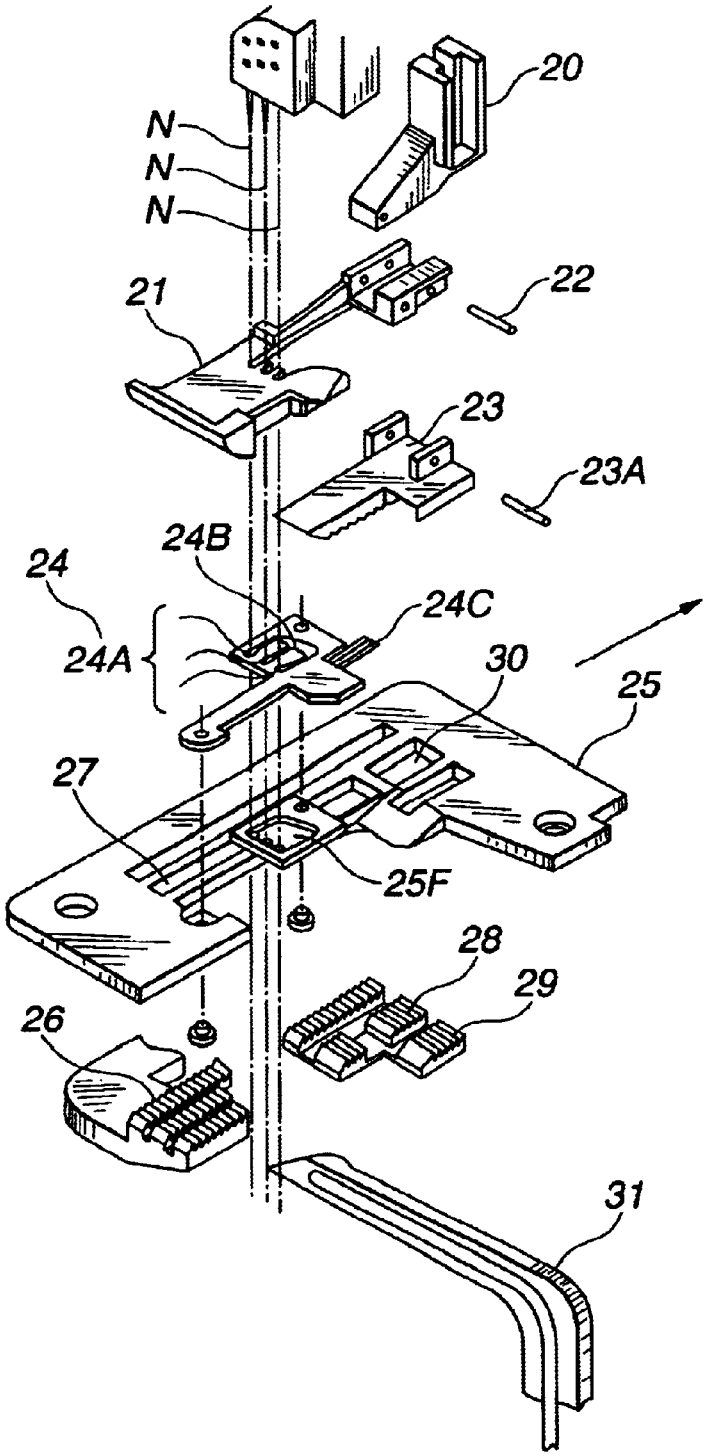
FIG.8 PRIOR ART
FIG. 8 is an exploded view showing a conventional cloth holding device and throat plate.
Figure 9:
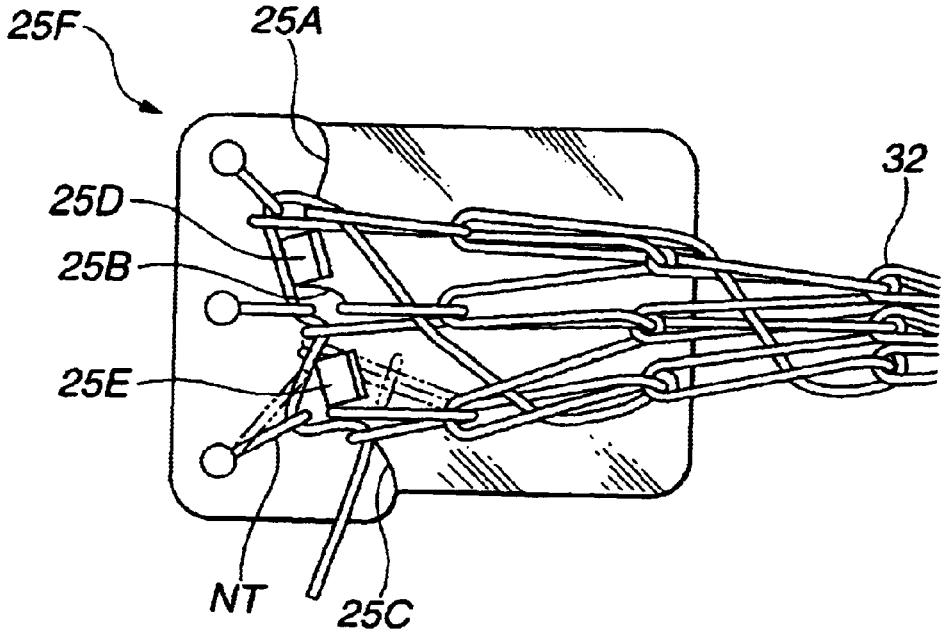
FIG.9 PRIOR ART
FIG. 9 is a plan view showing a state of loops of the conventional technique.
Figure 10:
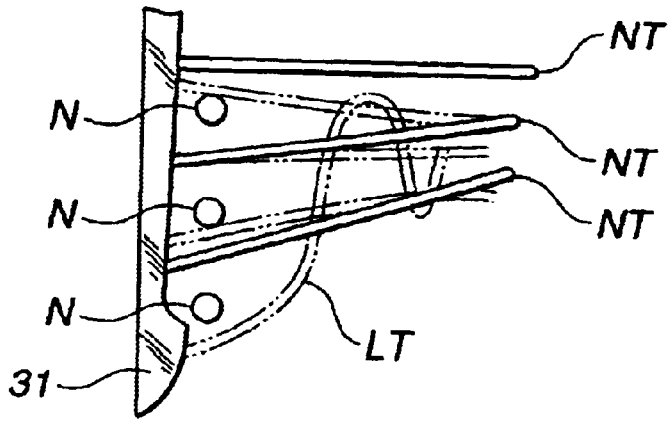
FIG.10 PRIOR ART
FIG. 10 is a plan view showing needle threads caught by the looper of the conventional technique, and a state of the looper thread.
Figure 11:
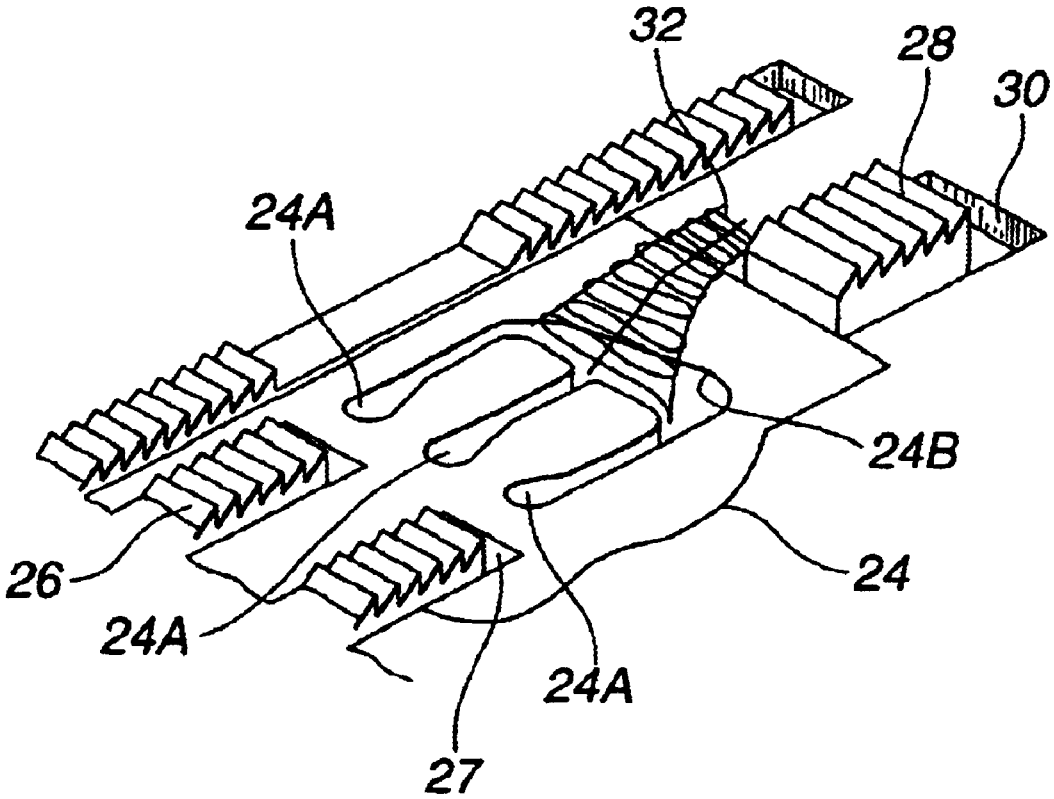
FIG.11 PRIOR ART
FIG. 11 is a perspective view showing a state of the loops by the conventional technique.

FIGS. 7A and 7B are diagrams showing another embodiment of the thread guide surface of the throat plate.

A thread guide surface 11E shown in FIG. 7A is formed to have a planar shape so configured that both sides of it are arcuate, and the upper end face is chamfered off to be arcuate.

A thread guide surface 11E shown in FIG. 7B is linearly formed in a planar shape, and the upper end face thereof is chamfered off to be linear.

As seen from the foregoing description, in the chainstitch sewing machine mentioned above, the loops are fed out by a loop holder and a loop feed dog, the loops are expanded, so that the needle threads being in contact with the thread guide surface move along the guide surface and in a direction that the needle threads separate from each other. As a result, the needle threads are caught by the looper, a called triangle of a needle thread NT extending in the cloth feeding direction becomes large. The needle reliably drops into the triangle, and no stitch skipping occurs. Accordingly, the loops are formed reliably.

In the chainstitch sewing machine having the last mentioned feature, a plurality of needle thread loops ranging from the under surface of the looper to the thread guide surface are moved in the cloth feeding direction while contacting with the arcuate chamfered part of the thread guide surface. Therefore, no thread breakage occurs and the loops can reliably be formed.

In the chainstitch sewing machine, a plurality of needle thread loops ranging from the under surface of the looper to the thread guide surface are reliably guided by the thread guide grooves. This feature ensures reliable formation of the loops.

The loops are smoothly retracted, so that beautiful stitches are formed.

In the chainstitch sewing machine having this feature, the needle threads are caught by the looper, a called triangle of a needle thread NT extending in the cloth feeding direction becomes large. The needle reliably drops into the triangle, and no stitch skipping occurs. Accordingly, the loops are formed reliably.

The feeding of the loops in the cloth feeding direction is smooth, and the loops are reliably formed.

What is claimed is:

1. A chainstitch sewing machine having a plurality of needles having needle threads which are moved up and down through needle holes of a throat plate, a looper having a looper thread, which is reciprocatively moved in a direction orthogonal to a cloth feeding direction under said throat plate, guide holes provided in said throat plate for guiding loops, which is formed by said needle threads and a looper thread by cooperation of said needles and said looper, to a rear part in a cloth feeding direction, and a main feed dog, disposed at a part closer to a rear than said guide hole, for feeding said loops in the cloth feeding direction, the improvement being characterized in that the upper end edge of said needle hole located at a rear part as viewed in the cloth feeding direction, takes a planar shape configured such that a part thereof located closer to the forward movement end of said looper is gradually varied toward the needles with respect to a straight line orthogonal to a cloth feed direction, and a thread guide surface, which is chamfered off to become thin in the forward direction of said looper and toward the lower surface of the throat plate, is provided on the upper edge of said guide hole.

2. A chainstitch sewing machine according to claim 1, wherein said planar shape is arcuate.

3. A chainstitch sewing machine according to claim 1, wherein said thread guide surface is chamfered to be arcuate.

4. A chainstitch sewing machine according to claim 1, wherein a plurality of thread guide grooves for guiding a plurality of needle thread loops ranging from the under surface of said looper to said thread guide surface are provided in the lower surface of said throat plate located between a needle location part of said throat plate and said thread guide surface of said guide hole.

5. A chainstitch sewing machine according to claim 4, wherein a rear pat of each said thread guide grooves is arcuate directed downward in the cloth feeding direction.

6. A chainstitch sewing machine according to claim 1, wherein said thread guide surface said thread guide grooves closer to on the backward movement end of said looper are located at positions closer to outside than a needle location located closer to the backward movement end of said looper.

7. A chainstitch sewing machine according to claim 1, wherein the width of said main feed dog is broader than the width of a plurality of needle location parts of said throat plate.

* * * * *